US006159082A

United States Patent [19]

Sugiyama et al.

[11] Patent Number: 6,159,082

[45] Date of Patent: Dec. 12, 2000

[54] SLURRY CIRCULATION TYPE SURFACE POLISHING MACHINE

[76] Inventors: Misuo Sugiyama; Xu Jin Wang; Shinya Iida, all of 2647, Hayakawa, Ayase-shi, Japan

[21] Appl. No.: 09/257,726

[22] Filed: Mar. 2, 1999

[30] Foreign Application Priority Data

Mar. 6, 1998 [JP] Japan ..... 10-073455

[51] Int. Cl.[7] ..... B24B 1/00

[52] U.S. Cl. ..... 451/285; 451/60; 451/446

[58] Field of Search ..... 451/60, 446, 456, 451/41, 285–289

[56] References Cited

U.S. PATENT DOCUMENTS 5,113,622 5/1992 Nishiguchi et al. ..... 451/57

5,664,990 9/1997 Adams et al. ..... 451/60

5,993,647 11/1999 Huang et al. ..... 451/60

6,006,738 12/1999 Itoh et al. ..... 125/21

*Primary Examiner*—David A. Scherbel

*Assistant Examiner*—George Nguyen

*Attorney, Agent, or Firm*—Snell & Wilmer, L.L.P.

[57] ABSTRACT

The bottom of each collection groove for collecting a used abrasive slurry and a rinsing solution is formed like the letter V, an exhaust port is formed at the lowest position of the bottom of the groove, the collection pipe of a slurry supply unit and the collection pipe of a rinsing solution supply unit are connected to the exhaust port, and the collection pipe of the rinsing solution exhaust unit is connected to a suction pump for forcedly discharging the rinsing solution by suction.

5 Claims, 2 Drawing Sheets

SLURRY CIRCULATION TYPE SURFACE POLISHING MACHINE

FIELD OF THE INVENTION

The present invention relates to a slurry circulation type surface polishing machine for polishing a workpiece while an abrasive slurry is circulated.

PRIOR ART

When a semiconductor wafer is chemically polished (CMP polishing) by a surface polishing machine such as a polishing machine, an abrasive slurry prepared by dispersing free abrasive grains in an acidic or alkaline solution is used, a wafer is polished while the slurry is supplied to a disc, a rinsing solution such as purified water is supplied to wash the wafer, and the wafer is then taken out. The used slurry and rinsing solution are caused to flow into a collection groove from the disc, the slurry is collected and recycled, and the rinsing solution is collected to another drainage disposal apparatus.

However, in the polishing machine of the prior art, in the initial stage where the step proceeds to the next polishing step to start the circulation of the slurry after one polishing step is over, the rinsing solution not discharged completely and remaining in the collection groove is collected together with the slurry and the slurry is diluted with this rinsing solution with the result of a change in pH, thereby reducing the polishing rate.

This problem is caused by the fact that the conventional collection groove is constituted such that it has a flat bottom and discharges the rinsing solution naturally by its weight, thereby making it difficult to discharge the rinsing solution quickly and completely with the result that it is easily left on the flat bottom of the collection groove.

According to experiments conducted by the inventors of the present invention, it has been found that when a 5-liter slurry feed tank is used to circulate the slurry, about 20% of the rinsing solution is mixed in each step and the polishing rate is thereby reduced by about 20%.

Therefore, very troublesome and time-consuming work such as the analysis of the components of the collected slurry and the adjustment of pH by the addition of a drug must be carried out frequently in the prior art and hence, much time and labor and a bulky and expensive component adjusting apparatus are required for that work.

SUMMARY OF THE INVENTION

The technical object of the present invention is to prevent the rinsing solution used in the previous step from remaining in the collection groove and the remaining rinsing solution from being collected together with the slurry and mixed with the slurry in the following step in the slurry circulation type surface polishing machine.

To attain the above object, according to a first aspect of the present invention, there is provided a surface polishing machine which comprises a disc for polishing a workpiece, a slurry supply unit for circulating an abrasive slurry to the disc, a rinsing solution supply unit for supplying a rinsing solution for washing, collection grooves for collecting the used slurry and rinsing solution flowing out from the disc and a rinsing solution exhaust unit for discharging the rinsing solution in the collection grooves, wherein the bottom of each of the collection grooves has an inclined surface without a horizontal flat portion, an exhaust port is formed at the lowest position of the bottom, a collection pipe of the slurry supply unit and a collection pipe of the rinsing solution exhaust unit are connected to the exhaust port by a passage switching valve, and the collection pipe of the rinsing solution exhaust unit is connected to suction means for forcedly discharging the rinsing solution in the collection grooves by suction.

In the surface polishing machine of the present invention having the above constitution, the workpiece set on the disc is polished while the abrasive slurry is circulated from the slurry supply unit, washed by supplying the rinsing solution such as purified water and taken out from the disc. Thereafter, a new workpiece is set to repeat the same polishing.

The slurry and rinsing solution supplied over the disc at the time of polishing are collected or discharged through the collection grooves. Since the bottom of each of the collection grooves is inclined, the exhaust port is formed at the lowest position of the bottom, and the used rinsing solution is forcedly discharged by suction from the exhaust port at the time of using the rinsing solution, the rinsing solution is discharged quickly and with certainty and does not remain in the collection grooves. Therefore, even when the circulation of the slurry is started in the following polishing step, the rinsing solution is not mixed with the slurry and hence, there are no such problems as a change in the properties of the slurry due to the mixing of the rinsing solution and a reduction in polishing rate due to a change in the properties. Therefore, the trouble of analyzing and adjusting the components of the slurry and a complicated and bulky component adjusting apparatus are not required.

According to another aspect of the present invention, there is provided a surface polishing machine wherein solution collection grooves for collecting the slurry or rinsing solution flowing out from the disc into the collection grooves are formed at the periphery of the disc, the bottom of each of the solution collection grooves has an inclined surface without a horizontal flat portion, and an exhaust port communicating with the collection groove is formed at the lowest position of the bottom.

According to still another aspect of the present invention, there is provided a surface polishing machine wherein the slurry supply unit comprises a solution feed tank for storing the slurry, a feed pipe for supplying the slurry in the solution feed tank to the disc through a nozzle, a collection pump for collecting the slurry flowing into the collection grooves to the solution feed tank and a filter for purifying the collected slurry, and the solution feed tank is connected to a stock solution tank for supplying a slurry stock solution.

DETAILED DESCRIPTION OF THE PREFERRED EMBODIMENTS

Figure 1:
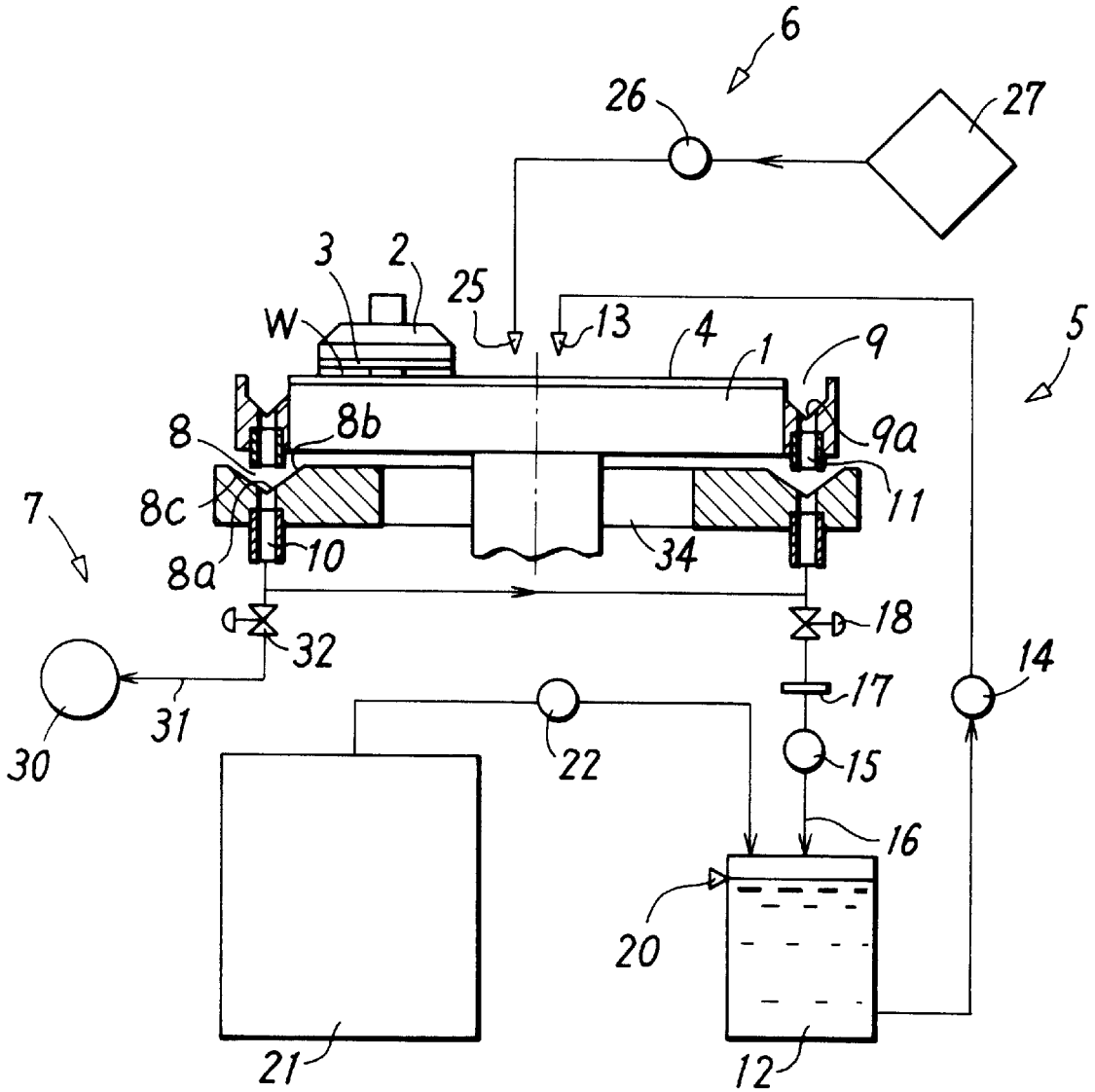
FIG. 1 is a schematic side view of a surface polishing machine according to an embodiment of the present invention.

FIG. 1 shows schematically a surface polishing machine according to an embodiment of the present invention. This polishing machine basically has the same structure as a known surface polishing machine and comprises a disc 1 for polishing which is installed in such a manner that it can be driven and turned round a perpendicular central axis and a pressure head 2 which can be moved vertically by an unshown air cylinder. A holding block 3 for holding a plate workpiece W such as a semiconductor wafer is installed under the pressure head 2, and the workpiece W held by the holding block 3 is pressed against the surface polishing pad 4 of the disc 1 by the pressure head 2 to be polished. A plurality of the pressure heads 2 are provided around the central axis of the disc 1.

The above polishing machine comprises a slurry supply unit 5 for circulating an abrasive slurry to the disc 1 at the time of polishing the workpiece W, a rinsing solution supply unit 6 for supplying a rinsing solution for washing after polishing with the slurry, collection grooves for collecting the used slurry and rinsing solution through solution collection grooves 9 at the periphery of the disc, and a rinsing solution exhaust unit 7 for discharging the rinsing solution flowing into the collection groove 8.

The slurry supply unit 5 comprises a solution feed tank 12 for storing the slurry, a feed pump 14 for supplying the slurry in the solution feed tank 12 over the disc 1 through a nozzle 13 located above a central portion of the disc 1, a collection pump 15 for forcedly collecting the used slurry flowing into the collection grooves 8 through exhaust ports 11 from the solution collection grooves 9 at the periphery of the disc to the solution feed tank 12 through a collection pipe 16, and a filter 17 for purifying the collected slurry. The collection pipe 16 is connected to exhaust ports 10 formed in bottom portions of the collection grooves 8 through first solenoid valve 18.

When the slurry is collected and recycled, the collected slurry contains foreign substances having various grain diameters produced in the polishing step, dressing step and the like, for example, fine dust (of about 0.2 to 1 $\mu$m in diameter), agglomerated particles (of several to 10 $\mu$m in diameter) of the slurry, diamond abrasive grains fallen off from the dresser (of about 150 to 250 $\mu$m in diameter), and chips of a polishing pad (of about 100 to 1,000 $\mu$m in diameter) Therefore, it is desirable that the above filter 17 can remove all of these foreign substances.

In this case, all the foreign substances of different sizes may be removed with a single filter of fine mesh but there is a problem that the meshes of the filter are easily occluded. Therefore, it is desired to remove foreign substances of different sizes by installing a plurality of filters having different filtration sizes in a Line. For example, a first filter having a filtration size of 100 $\mu$m or more, a second filter having a filtration size of 1 to 100 $\mu$m and a third filter having a filtration size of 1 $\mu$m or less are installed from an upstream side to remove foreign substances starting with those having a large diameter with these filters in order.

A level sensor 20 for detecting a reduction in the level of the slurry is installed in the solution feed tank 12 at a desired height and a stock solution tank 21 for supplying a slurry stock solution is connected to the solution feed tank 12 through a feed pump 22 so that when the level sensor 20 detects the level of the slurry, a predetermined amount of the slurry stock solution is supplied to the solution feed tank 12 from the stock solution tank 21.

The above rinsing solution supply unit 6 has a nozzle 25 located above a central portion of the disc 1 and a rinsing solution source 27 connected to the nozzle 25 through a feed pump 26 so that the rinsing solution such as purified water is supplied to the disc 1 through the nozzle 25 after the polishing of the workpiece W with the slurry. The nozzle 25 may also serve as the nozzle 13 for supplying the slurry.

The above rinsing solution exhaust unit 7 sucks the rinsing solution in the collection grooves 8 by a suction pump 30 to forcedly discharge the rinsing solution, and a collection pipe 31 communicating with the suction pump 30 is connected to the exhaust ports 10 of the collection grooves 8 through a second solenoid valve 32.

Figure 2:
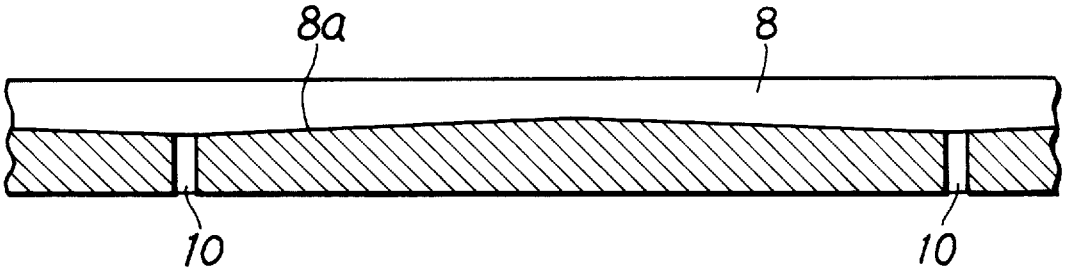
FIG. 2 is a partial sectional view of a collection groove cut along the circumference thereof.

The above collection grooves 8 for collecting or discharging the used slurry and rinsing solution are formed annularly in a support member 34 fixed under the disc 1, each of the grooves is V-shaped as a whole with two groove walls 8*b* and 8*c* inclined linearly, and the above exhaust port 10 is formed at the lowest position of the bottom 8*a* of the groove. The number of the exhaust ports 10 may be one but preferably plural at equal intervals in a circumferential direction. When a plurality of exhaust ports 10 are formed, it is desired that wavy level differences should be formed in a circumferential direction on the bottom 8*a* of the collection groove 8 as shown in FIG. 2 and each of the exhaust ports 10 should be formed in the lowest valley portion. It is needless to say that it is desirable that even when a single exhaust port 10 is formed, such a level difference should be formed.

Figure 3A:
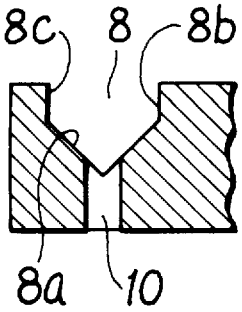
FIGS. 3A, 3B and 3C are sectional views showing different shapes of the collection groove.
Figure 3B:
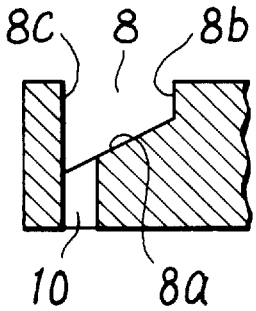
Figure 3C:
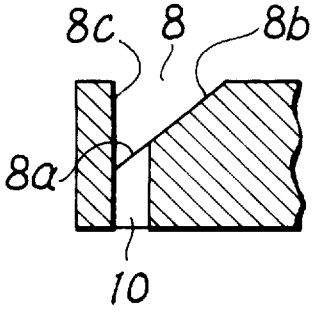
Figure 4:
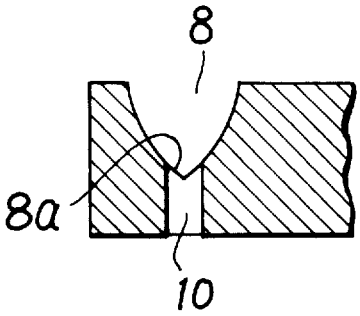
FIG. 4 is a sectional view showing still another shape of the collection groove.

In the embodiment shown in FIG. 1, the whole collection groove 8 has a bisymmetrical V-shaped section. The shape of the section of the collection groove 8*s* is not limited to this. For example, the inner and outer walls 8*b* and 8*c* of the groove are perpendicular and only the bottom 8*a* of the groove is inclined like the letter V as shown in FIG. 3A, the walls 8*b* and 8*c* of the groove are perpendicular and the bottom 8*a* inclines linearly from the wall 8*b* toward the other wall 8*c* as shown in FIG. 3B, or one wall 8*c* is perpendicular and the other wall 8*b* and the bottom 8*a* of the groove are continuously arranged in a straight line with inclination as shown in FIG. 3C. Alternatively, as shown in FIG. 4, the inclined surface of the bottom 8*a* may be slightly curved. In short, if the bottom 8*a* is an inclined surface without a horizontal flat portion, the inclined surface may be linear or curved.

Each of the solution collection grooves 9 formed at the periphery of the disc 1 has a V-shaped and inclined bottom 9*a* like the collection groove 8 and the above exhaust port 11 is formed at the lowest position of the bottom 9*a*. Since the solution collection groove 9 rotates together with the disc 1 in this case, it is desired that the outer wall of the groove should be perpendicular as shown in the figures so that an abrasive solution does not flow out by centrifugal force.

In the surface polishing machine having the above constitution, the workpiece held by the block 3 is pressed against the pad surface of the turning disc 1 by the pressure head 2 and polished by the slurry supplied to the pad surface through the nozzle 13 from the solution feed tank 12 of the slurry supply unit 5. At this point, the used slurry flows into the solution collection grooves 9 from the periphery of the disc 1, flows into the collection grooves 8 from the exhaust ports 11, and is collected into the solution feed tank 12 by the collection pump 15 through the opened first valve 18 and the filter 17 and recycled.

When polishing with the slurry is completed, the feed pump 14 and the collection pump 15 stop operation, the first valve 18 is closed to stop the supply of the slurry, the rinsing solution supply unit 6 and the rinsing solution exhaust unit 7 start operation, the second valve 32 is opened, the rinsing solution is supplied to the pad surface, and processing with the rinsing solution is carried out. At this point, it is desired that the closing of the first valve 18, the supply of the rinsing solution and the opening of the second valve 32 should be carried out almost at the same time, or the closing of the first valve 18 should be carried out a little earlier to prevent the rinsing solution from being mixed with the collected slurry.

By opening and closing the valves 18 and 32 at the above timings, part of the slurry is discharged together with the rinsing solution without being collected, whereby the level of the solution feed tank 12 lowers, the level sensor 20 starts operation, and a predetermined amount of the slurry stock solution is automatically supplied to the solution feed tank 12 from the stock solution tank 21.

The above rinsing solution supplied over the disc 1 from the nozzle 25 flows into the solution collection grooves 9 at the periphery of the disc 1, flows into the collection grooves 8 from the exhaust ports 11, and is sucked by the suction pump 30 through the opened second valve 32 and forcedly discharged.

Since the bottom portion 8*a* of the collection groove 8 is inclined and the exhaust port 10 is formed at the lowest position of the bottom portion 8*a*, the rinsing solution easily flows into the exhaust ports 10 and is forcedly sucked by the suction pump 30 from the exhaust ports 10, whereby the rinsing solution is discharged quickly and with certainty by the multiplication effect of these and does not remain in the collection groove 8.

When processing with the rinsing solution is completed, the processed workpiece is taken out and a new workpiece is set on the block 3 to repeat the same polishing and processing as described above. Since the rinsing solution in the solution collection grooves 9 and the collection grooves 8 is almost completely eliminated at this point, the remaining rinsing solution is not mixed with the slurry even when the circulation of the slurry is started.

Therefore, there are no such problems as a change in the properties of the slurry due to the mixing of the rinsing solution and a reduction in polishing rate due to the change in the properties. Consequently, the trouble of analyzing and adjusting the components of the slurry and a complicated and bulky component adjusting apparatus are not required.

According to the present invention, since the bottom of the collection groove is inclined so that the rinsing solution can easily flow out and the exhaust port is connected to the suction means to forcedly suck the rinsing solution, the rinsing solution can be discharged quickly and prevented from remaining in the collect ion grooves without fail. As a result, even when the circulation of the slurry is started in the next polishing step, the remaining rinsing solution is not mixed with the slurry. Therefore, there are no such problems as a change in the properties of the slurry and a reduction in polishing rate, and the trouble of analyzing and adjusting the components of the slurry and a complicated and bulky component adjusting apparatus are not required.

What is claimed is:

1. A slurry circulation type surface polishing machine comprising a disc for polishing a workpiece, a slurry supply unit for circulating an abrasive slurry to said disc, a rinsing solution supply unit for supplying a rinsing solution for washing, collection grooves for collecting the used slurry and rinsing solution flowing out from said disc, and a rinsing solution exhaust unit for discharging the rinsing solution in said collection grooves, wherein:

the bottom of each of said collection grooves consists of at least one inclined surface;

an exhaust port is formed at the lowest position of said bottom;

a collection pipe of said slurry supply unit is connected to said exhaust port through a first passage switching valve and a collection pipe of said rinsing solution exhaust unit is connected to said exhaust port through a second passage switching valve; and the collection pipe of said rinsing solution exhaust unit is connected to a suction means for forcedly discharging the rinsing solution in said collection grooves by suction.

2. The surface polishing machine of claim 1, wherein:

solution collection grooves for collecting the slurry and the rinsing solution flowing out from said disc and flowing into said collection grooves are formed at the periphery of said disc;

the bottom of each of said solution collection grooves consists of at least one inclined surface; and an exhaust port communicating with said solution collection groove is formed at the lowest position of said bottom.

3. The surface polishing machine of claim 1, wherein the bottom of said collection groove has a substantially V-shaped section.

4. The surface polishing machine of claim 2, wherein the bottoms of said collection groove and said solution collection groove have a substantially V-shaped section.

5. The surface polishing machine of claim 1, wherein said slurry supply unit comprises:

a solution feed tank for storing the slurry;

a feed pump for supplying the slurry in said solution feed tank through a nozzle;

a collection pump for collecting the slurry flowing into said collection grooves to said solution feed tank;

a filter for purifying the collected slurry; and wherein said solution feed tank is connected to a stock solution tank for supplying a slurry stock solution.

* * * * *